US006886610B2

(12) United States Patent
Feygin

(10) Patent No.: US 6,886,610 B2
(45) Date of Patent: May 3, 2005

(54) LIQUID DISPENSER

(75) Inventor: Ilya Feygin, Mountainside, NJ (US)

(73) Assignee: TechElan, Mountainside, NJ (US)

( * ) Notice: Subject to any disclaimer, the term of this patent is extended or adjusted under 35 U.S.C. 154(b) by 0 days.

(21) Appl. No.: 10/448,852

(22) Filed: May 30, 2003

(65) Prior Publication Data

US 2003/0228242 A1 Dec. 11, 2003

Related U.S. Application Data

(60) Provisional application No. 60/386,147, filed on Jun. 5, 2002.

(51) Int. Cl.[7] ..... B65B 1/04

(52) U.S. Cl. ..... 141/234; 222/214; 141/130

(58) Field of Search ..... 141/130, 114, 141/234–245; 222/263, 214, 101, 491, 206; 73/863.33, 864.11, 863.32; 422/99, 100

(56) References Cited

U.S. PATENT DOCUMENTS 4,461,328 A * 7/1984 Kenney ..... 141/67
4,537,231 A * 8/1985 Hasskamp ..... 141/238
5,343,909 A * 9/1994 Goodman ..... 141/242

* cited by examiner

*Primary Examiner*—Steven O. Douglas
(74) *Attorney, Agent, or Firm*—DeMont & Breyer, LLC

(57) ABSTRACT

A dispenser that is capable of simultaneously filling a large array of receivers (e.g., wells, etc.) with nano-liter volumes of liquid at high accuracy. The dispenser has a very simple construction, is quite compact, and has few if any moving parts.

14 Claims, 2 Drawing Sheets

FIG. 1
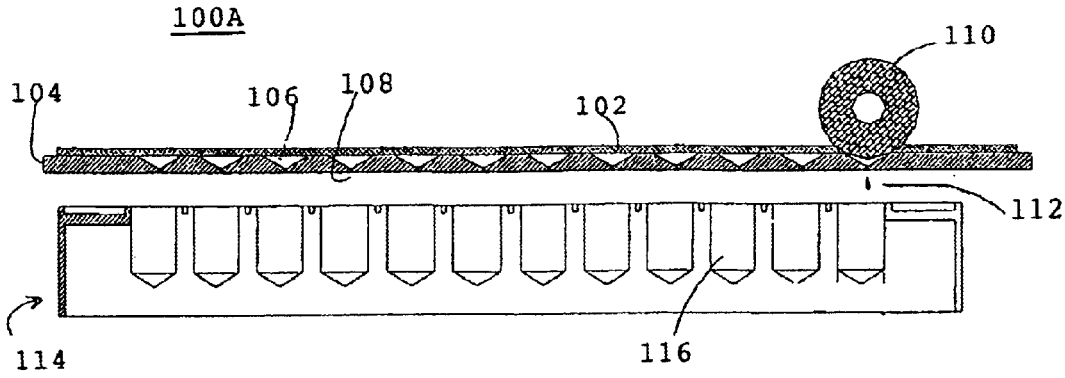
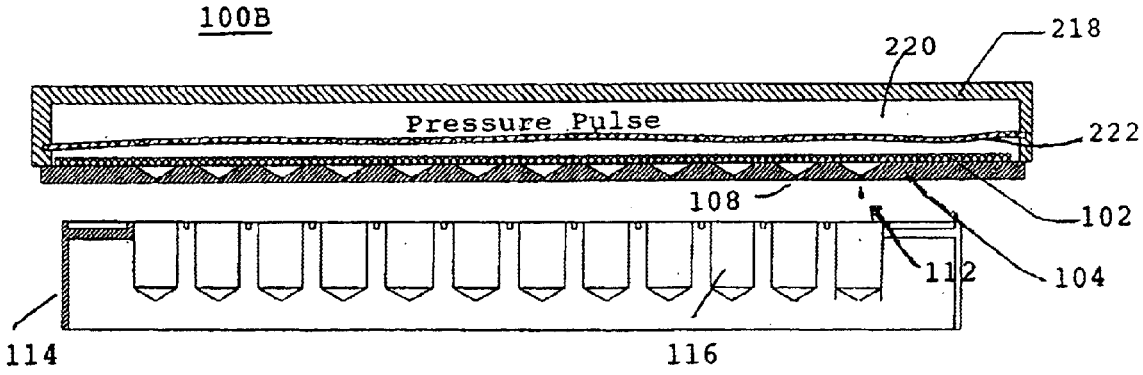
FIG. 2
FIG. 3
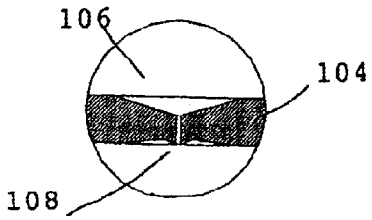

LIQUID DISPENSER

STATEMENTS OF RELATED CASES

This case claims priority of U.S. Provisional Patent Application 60/386,147 filed Jun. 5, 2002.

FILED OF THE INVENTION

The present invention relates generally to liquid dispensers. More particularly, the present invention relates to liquid dispensers that are capable of simultaneously dispensing very small quantities of liquid to an array of receivers.

BACKGROUND OF THE INVENTION

Many research applications require that very small (i.e., nano-liter), precisely-metered quantities of liquid are dispensed, simultaneously, into an array of receivers (e.g., wells in a multi-well plate, etc.). This is very difficult to do for a number of reasons.

In particular, if a common liquid-holding manifold having an array of valves/nozzles is used for dispensing, it is difficult to ensure that liquid flows equally through all of the valves/nozzles. Any non-uniform accumulation of matter in the manifold, or partial occlusions of some valves/nozzles, will result in flow imbalances. Furthermore, it is difficult to precisely control all micro-valves in the array.

Consequently, a need exists for a dispenser that is capable of accurately and simultaneously dispensing very small quantities of liquid into a plurality of receivers.

SUMMARY OF THE INVENTION

A dispenser in accordance with the illustrative embodiment of the present invention is capable of simultaneously filling a large array of receivers (e.g., wells, etc.) with nano-liter volumes of liquid at high accuracy. The dispenser has a very simple construction, is quite compact, and has few if any moving parts.

In accordance with the illustrative embodiment, a liquid-retaining material (e.g., sponge, etc.) holds a predetermined amount of liquid. The liquid is released from the liquid-retaining material by the application of pressure. The liquid is forced, by the applied pressure, through an array of precisely-sized openings that are disposed in a plate that underlies the liquid-retaining material. Receivers that underlie the plate receive the droplets of liquid that pass through the openings.

BRIEF DESCRIPTION OF THE DRAWINGS

FIG. 1 depicts a liquid dispenser in accordance with a first illustrative embodiment of the present invention.

FIG. 2 depicts a liquid dispenser in accordance with a second illustrative embodiment of the present invention.

FIG. 3 depicts a close-up of a dispensing nozzle for use in conjunction with the liquid dispensers of FIGS. 1 and 2.

DETAILED DESCRIPTION

Figure 4:
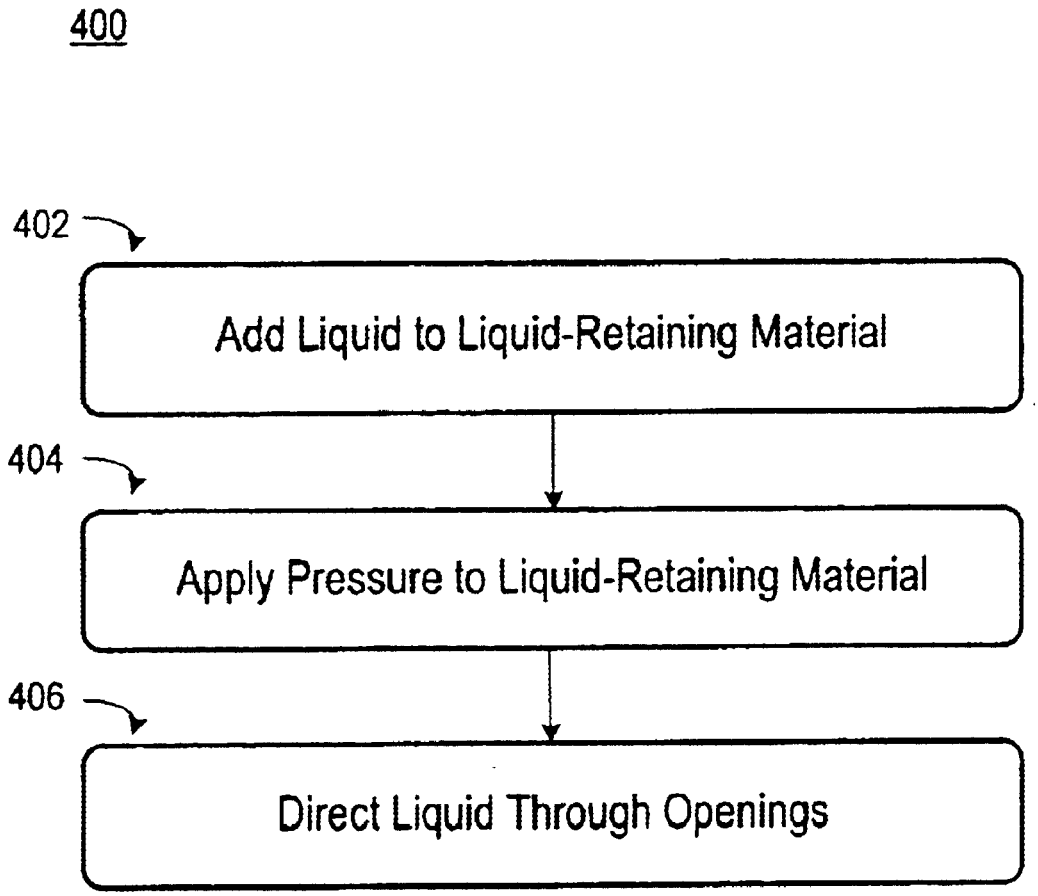
FIG. 4 depicts a method in accordance with the illustrative embodiments of the present invention.

In accordance with the illustrative embodiment, a liquid-retaining material (e.g., a hydrophilic material, an open cell sponge, etc.) holds a predetermined amount of liquid. The liquid is released from the liquid-retaining material by the application of pressure from a pressure-applying device. The liquid is forced, by the applied pressure, through an array of precisely-sized openings that are disposed in a plate that underlies the liquid-retaining material. Receivers (e.g., wells of a multi-well plate, etc.) that underlie the plate receive the droplets of liquid that pass through the openings.

FIG. 1 depicts dispenser 100A in accordance with a first illustrative embodiment of the present invention. Dispenser 100A includes liquid-retaining material 102, dispensing plate 104, and roller 110, interrelated as shown.

Liquid-retaining material 102 is filled with a predetermined amount of liquid. This can be done in a variety of ways, as is known to those skilled in the art. One way is to pour a predetermined amount of liquid onto liquid-retaining material 102. Another way to do this is by saturating liquid-retaining material 102 with liquid and then removing a specific amount of liquid, such as by passing material 102 through appropriately-spaced rollers.

Liquid-retaining material 102 is positioned over dispensing plate 104. The dispensing plate includes an array of spherical or conical indentations 106. At the bottom of each such indentation is a precisely-sized opening 108 (e.g., 0.1 mm diameter, etc.). (See also, FIG. 3.) The openings are sized to generate a drop that contains less than one micro-liter of liquid.

Roller 110, which serves as a pressure-applying device, contacts liquid-retaining material 102 and applies a consistent amount of downward-directed pressure to it. Liquid is forced out of liquid-retaining material 102 at the point of contact with roller 110. The ejected liquid flows into indentations 106. Droplet 112 containing a precise amount is formed by each opening 108. Droplet 112 is received by wells 116 of multi-well plate 114. In FIG. 1, plate 114 is an 8×12 multi-well plate, so that dispensing plate 104 is advantageously arranged with an 8×12 array of indentations 106. Thus, as roller 110 engages material 102, liquid is forced into 8 indentations 106 simultaneously. To dispense liquid into the next row of indentations 106, liquid-retaining material 102 is moved past roller 110, or the roller is moved over material 102. In some other variations, dispensing plate 104 is arranged with a 16×24 array of indentations to accommodate a 384-well multi-well plate, and in yet other variations, dispensing plate 104 is arranged with a 32×48 array of indentations to accommodate a 1536-well plate.

FIG. 2 depicts dispenser 100B in accordance with a second illustrative embodiment of the present invention. Dispenser 100B includes liquid-retaining material 102, dispensing plate 104, housing 218, and diaphragm 222, interrelated as shown.

Housing 218 and dispensing plate 104 define pressure chamber 220. Liquid-retaining material 102 overlies dispensing plate 104, and diaphragm 222 overlies material 102. A pulse of pressure (e.g., via a hose connection that is not depicted, etc.) is supplied or otherwise generated within pressure chamber 220 above diaphragm 222. As a result, diaphragm 222 is forced downward thereby squeezing liquid-retaining material 102. This squeezing forces at least some liquid out of liquid-retaining material 102 and through openings 108 in dispensing plate 104. In this embodiment, the pressure chamber, diaphragm and the device that delivers or generates the pulse of pressure compose the pressure-applying device.

Droplets 112 are dispensed, simultaneously, into wells 116 of underlying multi-well plate 114. A very low CV (coefficient of variation) is expected because the internal fluidic pressure will be evenly and instantaneously distributed across the entire internal volume and surface of material 102.

For dispenser 100B, liquid-retaining material 102 can be loaded with a predetermined amount of liquid by, for example, advancing material 102 through a cassette or cartridge that contains liquid, in the manner in which film is advanced through a camera. The cartridge would be located before pressure chamber 220. Alternatively, a roll of material 102 can be disposed in liquid. A portion of material 102 is advanced into chamber 220, liquid is dispensed, and the emptied material is drawn out of chamber 220. Additional material 102 laden with liquid is sequentially advanced into chamber 220 for dispensing. Liquid-retaining material 102 can be cycled back to receive more liquid and then again advanced in chamber 220.

Until pressure is applied, such as by roller 110 in the first embodiment, or by a pulse of pressure in the second embodiment, liquid-retaining material 102 retains liquid. Consequently, dispensers 100A and 100B do not require valves.

FIG. 4 depicts method 400 for dispensing liquid in accordance with the illustrative embodiments of the present invention. In accordance with operation 402, liquid is added to liquid-retaining material 102. Those skilled in the art will be able to provide material 102 with a predetermined amount of liquid, such as by using the techniques described above or other techniques that might occur to them in view of the present teachings.

In operation 404, pressure is applied to liquid-retaining material 102. The applied pressure forces at least some liquid out of the liquid-retaining material. Pressure can be applied in any of a variety of ways such as, without limitation, the roller technique or the pressure-pulse technique that have already been described.

The liquid that is forced out of liquid-retaining material 102 is directed, as per operation 406, through sized openings to create droplets containing a desired volume of liquid. This is done, in the illustrative embodiments, by positioning liquid-retaining material 102 on top of dispensing plate 104. The indentations 106 in dispensing plate 104 collect the liquid, which then passes through a hole at the bottom of each indentation.

It is to be understood that the above-described embodiments are merely illustrative of the present invention and that many variations of the above-described embodiments can be devised by those skilled in the art without departing from the scope of the invention. It is therefore intended that such variations be included within the scope of the following claims and their equivalents.

I claim:

1. A liquid dispenser comprising:

liquid-retaining material, wherein said liquid-retaining material is capable of internally retaining a quantity of liquid;

a dispensing plate disposed beneath said liquid-retaining material, wherein said dispensing plate comprises an array of sized openings; and a pressure-applying device, wherein said pressure-applying device applies pressure to said liquid-retaining material to force at least some of said quantity of liquid therefrom.

2. The liquid dispenser of claim 1 further comprising an array of receivers, wherein said receivers are disposed beneath said dispensing plate, and further wherein said receivers are arranged in an array that is complementary to said array of sized openings so that each said receiver receives a droplet of said liquid that is dispensed through each said sized opening.

3. The liquid dispenser of claim 1 wherein said pressure-applying device comprises a roller, wherein said roller contacts said liquid-retaining material.

4. The liquid dispenser of claim 1 wherein said pressure-applying device comprises:

a pressure chamber, wherein said liquid-retaining material is disposed in said pressure chamber; and a diaphragm, wherein said diaphragm is disposed within said pressure chamber, and wherein said membrane overlies said liquid-retaining material.

5. The liquid dispenser of claim 4, wherein said pressure-applying device further comprises a device for generating a pulse of pressure.

6. The liquid dispenser of claim 1 wherein said dispensing plate comprises an array of indentations, wherein one of said sized openings is disposed at a bottom of each of said indentations.

7. The liquid dispenser of claim 1 wherein said openings are disposed in an 8×12 array.

8. The liquid dispenser of claim 1 wherein said openings are disposed in an 16×24 array.

9. The liquid dispenser of claim 1 wherein said openings are disposed in an 32×48 array.

10. The liquid dispenser of claim 1 further comprising an arrangement for providing said liquid-retaining material with a predetermined amount of said liquid.

11. The liquid dispenser of claim 1 wherein said openings are less than 0.1 mm in diameter.

12. The liquid dispenser of claim 1 wherein said openings are sized to generate a droplet that contains less than a micro-liter of said liquid.

13. A method for dispensing, comprising:

adding liquid to a liquid-retaining material, wherein said liquid is retained within said liquid-retaining material;

applying pressure to said liquid-retaining material to force a portion of said liquid out of said liquid-retaining material; and directing said portion of liquid through an array of openings, wherein each opening has a precisely determined sized.

14. The method of claim 13 wherein said precisely determined size is determined such that a droplet that is formed by said opening contains less than a micro-liter of liquid.

* * * * *